US006039049A

United States Patent [19]

Piperato et al.

[11] Patent Number: 6,039,049

[45] Date of Patent: Mar. 21, 2000

[54] METHOD FOR PREVENTING CLOSURE OF BODY PIERCING OPENINGS

[76] Inventors: Michael C. Piperato; Edward L. Zimerla, both of 2680 Rte. 9, South Howell, N.J. 07731

[21] Appl. No.: 09/094,376

[22] Filed: Jun. 10, 1998

Related U.S. Application Data

[62] Division of application No. 08/859,335, May 20, 1997, abandoned.

[51] Int. Cl.[7] ..... A61B 19/00

[52] U.S. Cl. ..... 128/898

[58] Field of Search ..... 128/898; 63/12

[56] References Cited

U.S. PATENT DOCUMENTS

| | | |
|---|---|---|
| D. 255,885 | 7/1980 | Andrews . |
| 3,500,829 | 3/1970 | Abramowitz . |
| 4,353,370 | 10/1982 | Evans . |
| 4,761,971 | 8/1988 | Freier . |
| 4,829,788 | 5/1989 | DiDomenico . |
| 5,146,768 | 9/1992 | Dichtel . |

OTHER PUBLICATIONS

V. Vale and Andrea Juno, eds., *RE/Search #12: Modern Primitives,* 1989, pp. 25, 109.

"Metal Morphosis" brochure—date and author unknown, Soho, London, United Kingdom, 2 pp.

*Primary Examiner*—Mickey Yu
*Assistant Examiner*—Kelly O'Hara
*Attorney, Agent, or Firm*—Richard C. Litman

[57] ABSTRACT

A method for preventing closure of a body piercing opening during medical procedures that necessitate removal of a metallic body jewelry. The method includes the stage of sterilizing a piece of non-metallic body jewelry; disengaging the piece of metallic body jewelry from an existing body piercing opening; and inserting the piece of non-metallic body jewelry into the existing body piercing opening to prevent its closure. Upon termination of the medical procedure, the piece of non-metallic body jewelry is removed from the opening and disposed of, and the piece of metallic body jewelry is reinserted into the existing body piercing opening. The disposable non-metallic body piercing jewelry is fabricated from a thermally and medically insert plastic, and emulates the structure and shape of permanent metallic body jewelry that is usually worn in piercing openings.

3 Claims, 2 Drawing Sheets

METHOD FOR PREVENTING CLOSURE OF BODY PIERCING OPENINGS

CROSS REFERENCE TO RELATED APPLICATION

This application is a division of application Ser. No. 08/859,335 filed on May 20, 1997, now abandoned.

BACKGROUND OF THE INVENTION

1. Field of the Invention

The present invention relates to specialized jewelry for body piercing, more specifically, to disposable body-piercing jewelry made from plastic for insertion into a body piercing opening during medical procedures that require the temporary removal of permanent metallic body-piercing jewelry, to ultimately prevent the undesired closure of the opening.

2. Description of the Relevant Art

Plastic piercing devices are well known and mainly relate to ear piercings. U.S. Pat. No. 4,829,788 discloses a pierced earring incorporating a composite metallic/plastic post. Likewise, U.S. Patent Des. 255,885 discloses a plastic pierced earring.

Other uses of plastic piercing devices for pierced ears involve the cleaning and maintenance of the piercing opening. U.S. Pat. No. 3,500,829 discloses an earhole piercing and treating apparatus, including a plastic anvil that may be sterilized without danger or harm thereto. The disposable plastic earring rod of U.S. Pat. No. 4,353,370 is medicated to prevent infection of the piercing opening, and to further promote the healing thereof. Also of note, U.S. Pat. No. 4,761,971 discloses a coating of inert plastic that shields a metallic earring, to prevent skin irritation in allergic individuals.

The above inventions apply exclusively to conventional piercings of the ear. Recently, decorative body piercings have become commonplace and fashionable. Alternative decorative body piercings, such as those of the nose, nipples, navel, tongue and genitalia, involve a more traumatic physical procedure, requiring additional medical precautions in both the initial piercing and the continued maintenance of the piercing jewelry afterward. Unlike conventional ear-piercing, the art of body-piercing features jewelry having a wide array of designs and shapes commensurate with multiple piercable areas of the body and the different types of piercings therefore, as illustrated in RE/Search #12: Modern Primitives at page 25. Various piercings of the nose, navel, nipple, tongue and genitalia have enjoyed great popularity with people of both sexes and of all lifestyles. In many cases, these locations are more prone to infection than earlobes, warranting the exercise of additional medical precautions in both the initial piercing procedure and the continued maintenance of the piercing afterward.

Moreover, temporarily removing the jewelry from the piercing opening creates problems, whereby the opening can "heal up quite soon" and ultimately necessitate re-piercing of the opening to replace the original jewelry. See RE/Search #12: Modern Primitives at page 109. Furthermore, the temporary removal of permanent metallic body-piercing jewelry, required prior to certain medical procedures, often results in at least partial closure of the piercing opening, ultimately necessitating re-piercing, and the additional physical trauma, expense, and emotional hardship associated therewith.

In light of the nature of such body piercing openings, and their extreme sensitivity to even temporary removal of the permanent metallic body-piercing jewelry, there is a need for disposable body-piercing jewelry made from plastic, for insertion into a body piercing opening during medical procedures that require the temporary removal of permanent metallic body-piercing jewelry, to ultimately prevent the undesired closure of the opening.

None of the above inventions and patents, taken either singly or in combination, is seen to describe the instant invention as claimed.

SUMMARY OF THE INVENTION

The present invention involves body piercing jewelry that is fabricated from an inert plastic, and meant to be disposed of after use. The structure and shape of the disposable body jewelry substantially emulates that of the permanent metallic body jewelry that is usually worn in the piercing opening. While undergoing invasive or diagnostic medical procedures that necessitate removal of the metallic body jewelry, a person inserts the disposable plastic jewelry of the present invention into the piercing opening to prevent undesired closure thereof.

The body jewelry of the present invention is fabricated from inert plastic, so as not to irritate the skin that borders the piercing opening. Furthermore, the plastic used must be able to withstand autoclave sterilization, which involves exposure to high temperatures for significant periods of time, without degrading, melting or otherwise incurring damage.

Accordingly, it is a principal object of the invention to prevent the undesired closure of a body piercing opening upon temporary removal of metallic body piercing jewelry therefrom.

It is another object of the invention to withstand autoclave sterilization at high temperatures for significant periods of time.

It is a further object of the invention to emulate the shades, sizes and styles of permanent metallic body jewelry.

Still another object of the invention is to avoid irritation of the skin that borders the piercing opening while the invention is in place.

It is an also object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
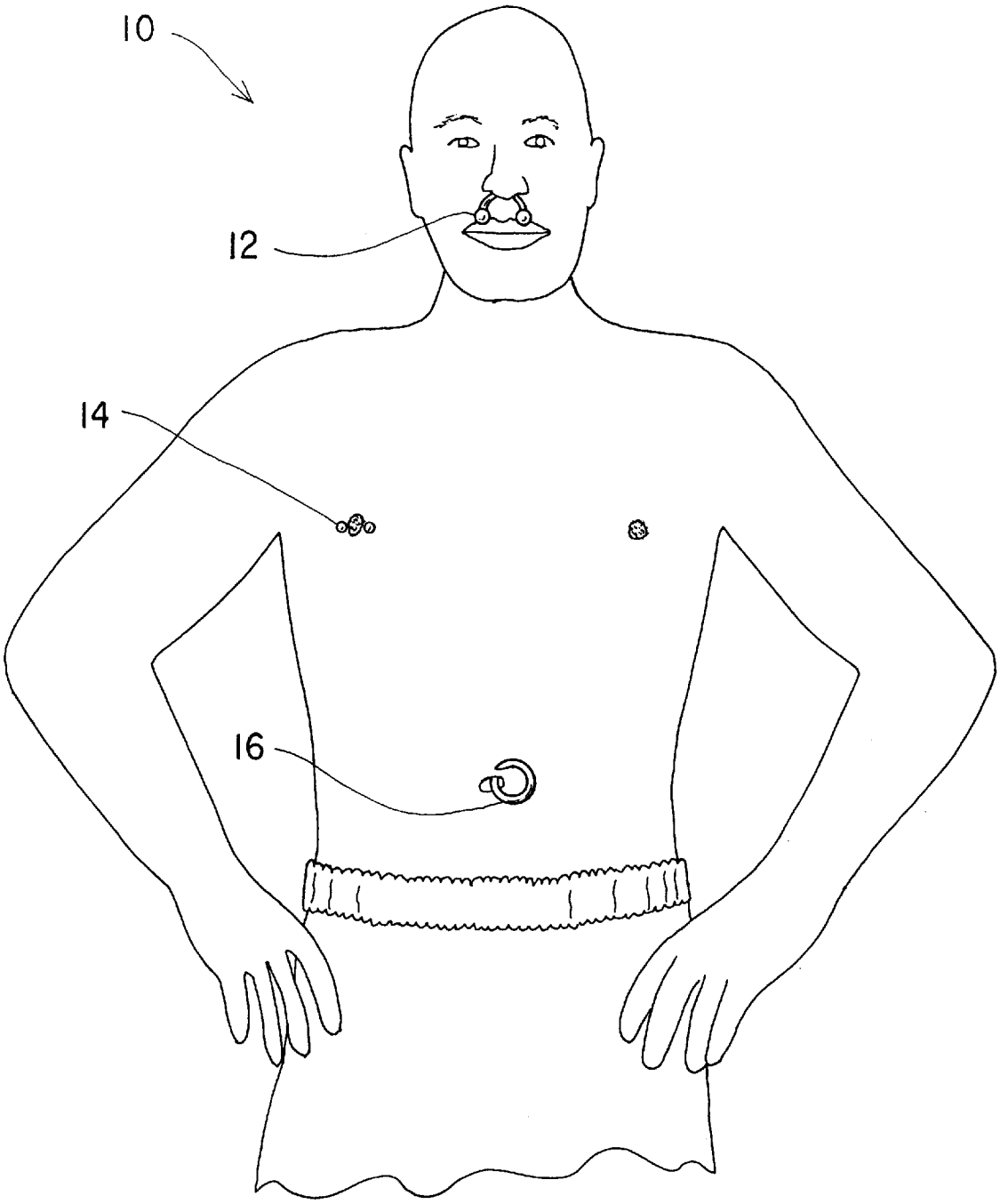
FIG. 1 is an environmental view of the disposable body jewelry of the present invention, as worn in existing body piercing openings.

The present invention involves body piercing jewelry that is fabricated from an inert plastic, and is meant to be disposed of after use. FIG. 1 illustrates a person 10 wearing multiple embodiments of the body piercing jewelry of the present invention, including a partial nose ring 12 that penetrates the septum, a barbell rod 14 that penetrates a nipple and a full navel ring 16.

The structure and shape of the disposable body jewelry of the present invention substantially emulates that of the permanent metallic body jewelry that is usually worn in the piercing opening. A wide assortment of metallic piercing jewelry is available, depending on the preference of the wearer, the location and style of the piercing and the way in which the piercing jewelry is secured within the piercing opening. The three jewelry embodiments described herein aim to explain the present invention, but in no way limit its applicability to all types and decorative styles of metallic body jewelry.

Figure 2:
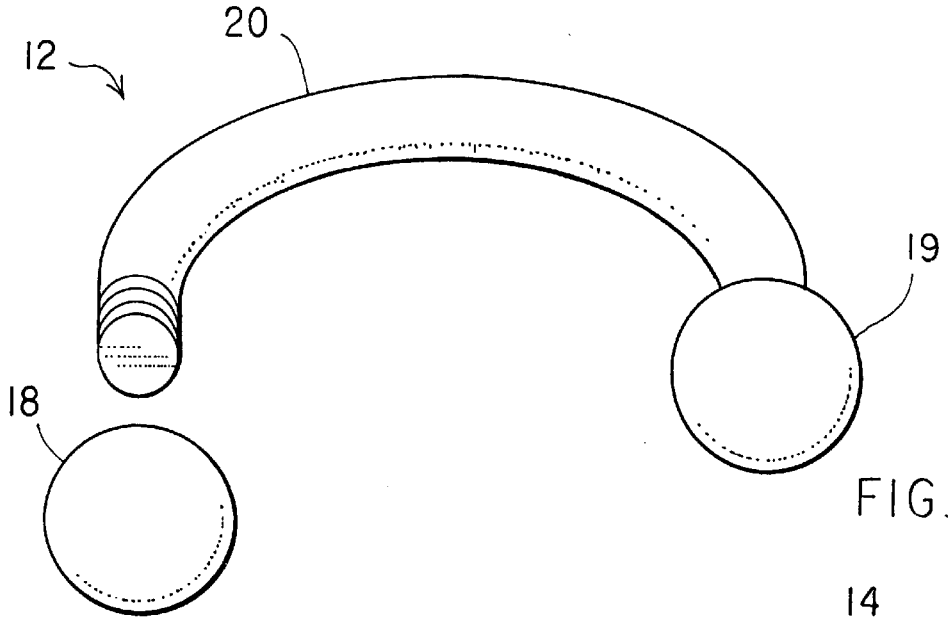
FIG. 2 is an elevational view of the partial ring embodiment of the disposable body jewelry of the present invention.

FIG. 2 illustrates partial nose ring 12, which comprises a substantially semicircular member 20 and two substantially spherical endpieces 18,19. Member 20 has a substantially circular cross section, and threadably engages spherical endpiece 18 at one end to removably secure partial nose ring 12 within the piercing opening in the septum.

Figure 3:
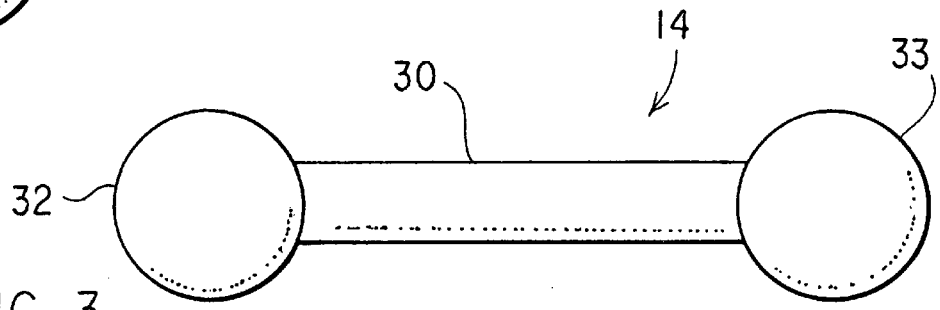
FIG. 3 is an elevational view of the barbell rod embodiment of the disposable body jewelry of the present invention.

FIG. 3 illustrates barbell rod 14, which comprises a substantially cylindrical member 30 and two substantially spherical endpieces 32,33. Member 30 has a substantially circular cross section, and threadably engages spherical endpiece 32 at one end to removably secure barbell rod 14 within the piercing opening in the nipple.

Figure 4:
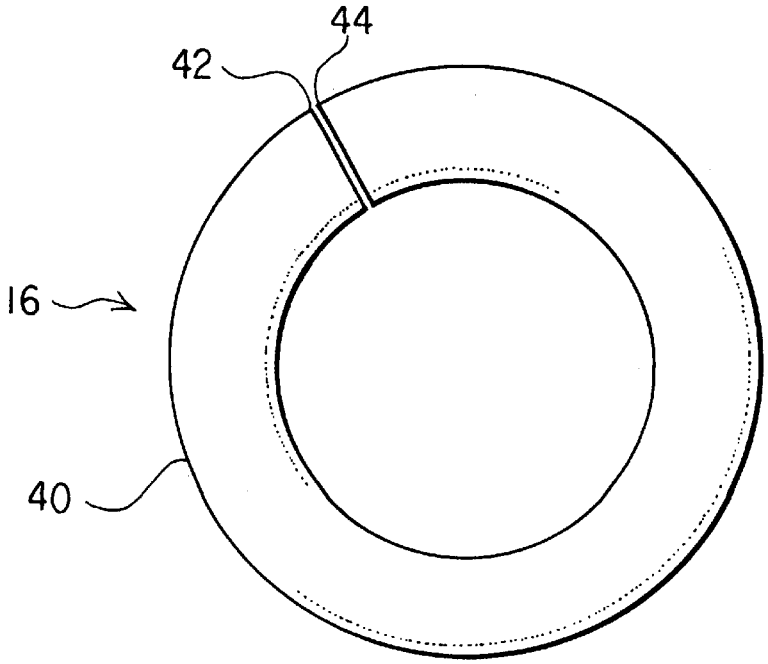
FIG. 4 is an elevational view of the full ring embodiment of the disposable body jewelry of the present invention.

FIG. 4 illustrates full navel ring 16. Navel ring 16 comprises a substantially circular member 40, having two ends 42,44, that frictionally engage each other to secure navel ring 16 within the piercing opening in the navel area.

The main purpose of the disposable body jewelry of the present invention involves its temporary insertion into piercing openings which otherwise contain permanent metallic piercing jewelry when invasive or diagnostic medical procedures necessitate the removal thereof. The disposable body jewelry of the present invention thereby prevents the healing up of the piercing opening, and allows trouble-free replacement of the original metallic body jewelry into the piercing opening after completion of the medical procedure.

The body jewelry of the present invention is fabricated from inert plastic, so as not to irritate the skin that borders the piercing opening. Furthermore, the plastic used must be able to withstand autoclave sterilization, which involves exposure to high temperatures for significant periods of time without degrading, melting or otherwise incurring damage. In the preferred embodiments of the invention, the disposable body jewelry is fabricated from polyculfun, thilate carbonate or polysulfonate ethermide, each of which has both the thermal integrity and medical inertness necessary for the purposes of the invention.

It is to be understood that the present invention is not limited to the sole embodiment described above, but encompasses any and all embodiments within the scope of the following claims.

What is claimed is:

1. A method for preventing closure of an existing body piercing opening during medical procedures that necessitate removal of metallic body jewelry from said existing body piercing opening, said method comprising:

sterilizing a piece of non-metallic body jewelry fabricated from a thermally and medically inert plastic, said piece of non-metallic body jewelry configured to substantially emulate a piece of metallic body jewelry;

disengaging the piece of metallic body jewelry from the existing body piercing opening;

inserting said piece of non-metallic body jewelry into said existing body piercing opening, said piece of non-metallic body jewelry preventing closure of said existing body piercing opening;

initiating a medical procedure;

terminating a medical procedure;

disengaging said piece of non-metallic body jewelry from said existing body piercing opening;

disposing of said piece of non-metallic body jewelry;

reinserting the piece of metallic body jewelry into said existing body piercing opening.

2. The method according to claim 1, wherein said plastic is selected from the group consisting of polyculfun, thilate carbonate, and polysulfonate ethermide.

3. The method according to claim 1, wherein said plastic is hypo-allergenic.

* * * * *